US009598233B2

(12) United States Patent
Harvey

(10) Patent No.: US 9,598,233 B2
(45) Date of Patent: Mar. 21, 2017

(54) COVER SYSTEM WITH TETHERING

(71) Applicant: Colorado Lining International, Inc., Parker, CO (US)

(72) Inventor: Andre Alan Harvey, Spring Valley, CA (US)

(73) Assignee: Colorado Lining International, Inc., Parker, CO (US)

( * ) Notice: Subject to any disclaimer, the term of this patent is extended or adjusted under 35 U.S.C. 154(b) by 0 days.

(21) Appl. No.: 14/091,899

(22) Filed: Nov. 27, 2013

(65) Prior Publication Data

US 2014/0151379 A1 Jun. 5, 2014

Related U.S. Application Data

(60) Provisional application No. 61/731,757, filed on Nov. 30, 2012.

(51) Int. Cl.
*B65D 88/34* (2006.01)
*B65D 88/38* (2006.01)

(52) U.S. Cl.
CPC ..... *B65D 88/34* (2013.01)

(58) Field of Classification Search
CPC ..... B65D 88/34
USPC ..... 220/216, 227
See application file for complete search history.

(56) References Cited

U.S. PATENT DOCUMENTS 251,245 A * 12/1881 King ..... 220/89.3
1,944,159 A * 1/1934 Bailey ..... 182/1
2,350,483 A * 6/1944 Wiggins ..... 220/216
2,355,874 A * 8/1944 Laird ..... 29/431
2,388,163 A * 10/1945 Laird ..... 220/216
3,313,443 A 4/1967 Dial et al.
3,800,911 A * 4/1974 Reynolds et al. ..... 182/18
4,202,458 A * 5/1980 Gunther ..... 220/721
4,648,968 A 3/1987 Cutler
4,714,175 A * 12/1987 Coers ..... 220/216
6,164,479 A * 12/2000 Kern ..... 220/216
RE41,442 E * 7/2010 Morgan ..... B09B 1/004 160/231.1

(Continued)

FOREIGN PATENT DOCUMENTS

GB 2332233 A 6/1999
JP 2005330011 A 12/2005
NL 9001869 A 3/1992

OTHER PUBLICATIONS

Layfield Environmental Systems press release "Evaporation Control Cover." http://www.cwneal.com/Article.cfm?articleid=20003.

(Continued)

*Primary Examiner* — J. Gregory Pickett
*Assistant Examiner* — Niki M Eloshway
(74) *Attorney, Agent, or Firm* — Holzer Patel Drennan

(57) ABSTRACT

In accordance with one implementation, a floating cover system includes a plurality of cover-tethering mounts mounted along the periphery of a holding tank. Each of the cover-tethering mounts includes a guide portion insertable through a cover-holding element that is attached along a periphery of a holding tank cover. When secured to the plurality of cover-tethering mounts, the holding tank cover can rise and fall within the holding tank responsive to volumetric changes in the liquid and/or gas contained in the holding tank.

20 Claims, 16 Drawing Sheets

(56) References Cited

U.S. PATENT DOCUMENTS

| | | | | |
|---|---|---|---|---|
| 7,793,390 | B2 | 9/2010 | Mills et al. | |
| 8,281,543 | B2 * | 10/2012 | Cook et al. | 52/745.06 |
| 2005/0035123 | A1 * | 2/2005 | Zhang | 220/216 |

OTHER PUBLICATIONS

Layfield Environmental Systems, press release "Modular Insulated Covers," http://www.cwneal.com/Article.cfm?articleid=20004.
Layfield Environmental Systems, press release "Defined Sump Covers," http://www.cwneal.com/Article.cfm?articleid=20005.
Layfield Environmental Systems, press release "REVOC® Tension Cable Covers," http://www.cwneal.com/Article.cfm?articleid=20007.
Layfield Environmental Systems, press release "Gas Collection Covers," http://www.cwneal.com/Article.cfm?articleid=20008.
International Searching Authority, U.S. Patent and Trademark Office; International Search Report for PCT/US2013/072354, dated Feb. 21, 2014, 3 pages.
International Searching Authority, U.S. Patent and Trademark Office; International Written Opinion for PCT/US2013/072354, dated Feb. 21, 2014, 3 pages.

* cited by examiner

COVER SYSTEM WITH TETHERING

CROSS-REFERENCE TO RELATED APPLICATIONS

The present application claims benefit of priority to U.S. Provisional Patent Application No. 61/731,757 entitled "Floating Cover System with Tethering" and filed on Nov. 30, 2012, which is specifically incorporated by reference for all that it discloses or teaches. Further, the present application also claims benefit of priority to U.S. Provisional Patent Application No. 61/890,965, entitled "Cover Panel Clip," filed on Oct. 15, 2013, which is also specifically incorporated by reference for all that it discloses or teaches.

BACKGROUND

Storage tanks and containment structures commonly used to store quantities of petroleum, waste, water, etc. may be used in combination with rigid or floating covers. Rigid covers can be difficult to remove and may require complex support mechanisms, such as cables or trusses. Although flexible and semi-rigid covers can be easier to position and maneuver, such covers are prone to lateral shifting and vulnerable to displacement by wind.

SUMMARY

Implementations described herein address the foregoing by providing a plurality of cover-tethering mounts spaced about the perimeter of a holding tank. Each of the cover-tethering mounts includes a mounting piece and a guide element. The mounting piece mounts to a sidewall of a holding tank and supports a guide element that descends into the holding tank. A tank cover includes a reinforced holding element that can slideably couple to a longitudinal axis of the guide element.

This Summary is provided to introduce an election of concepts in a simplified form that are further described below in the Detailed Description. This Summary is not intended to identify key features or essential features of the claimed subject matter, nor is it intended to be used to limit the scope of the claimed subject matter. Other features, details, utilities, and advantages of the claimed subject matter will be apparent from the following more particular written Detailed Description of various implementations and implementations as further illustrated in the accompanying drawings and defined in the appended claims.

BRIEF DESCRIPTIONS OF THE DRAWINGS

DETAILED DESCRIPTIONS

Figure 1:
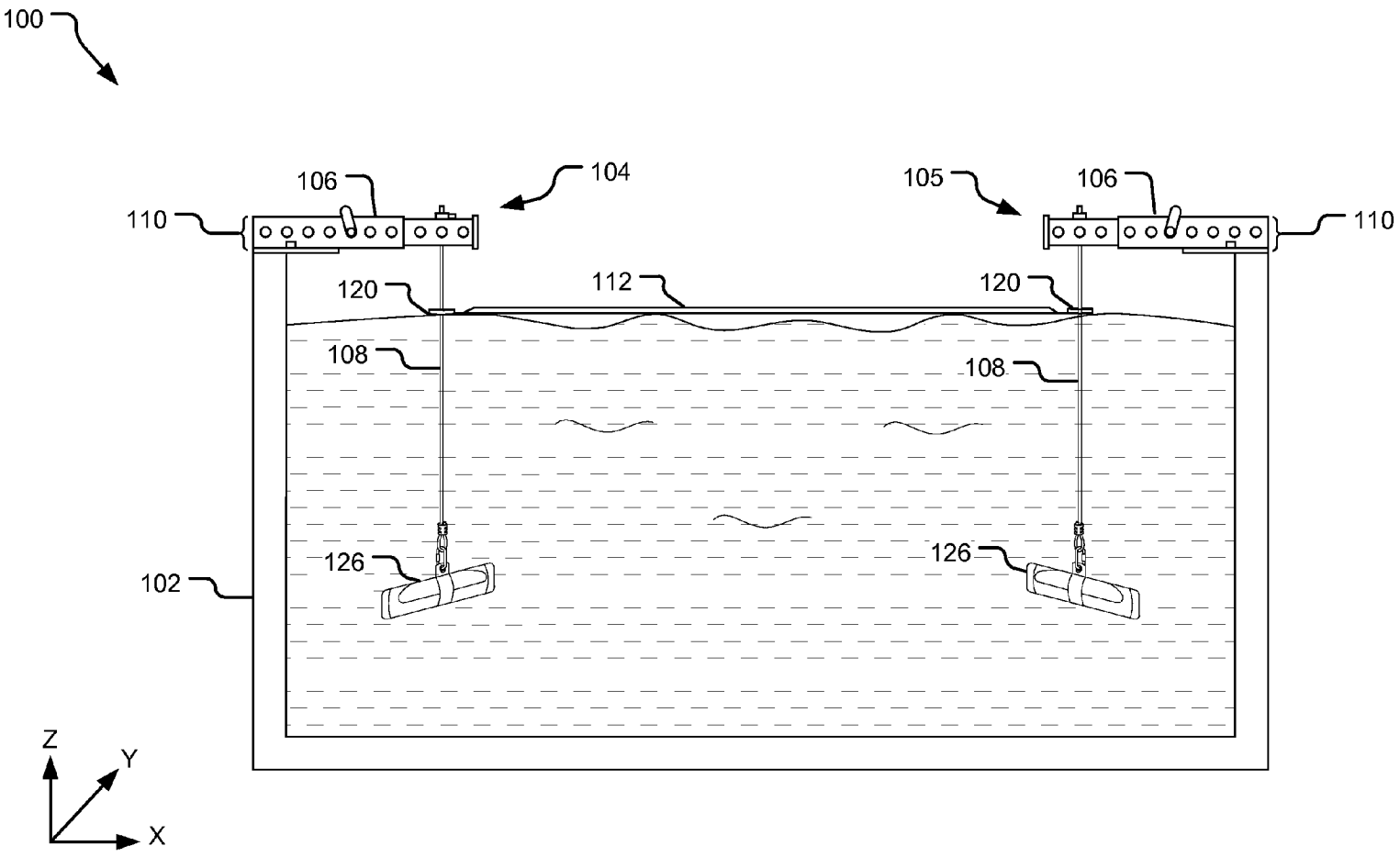
FIG. 1 illustrates a cross-sectional view of an example cover-tethering system.

FIG. 1 illustrates a cross-sectional view of an example cover-tethering system 100. The cover-tethering system 100 includes a plurality of cover-tethering mounts (e.g., cover-tethering mounts 104, 105) mounted along a perimeter of a holding tank 102. Each cover-tethering mount includes a mounted portion 110, a mast element 106, and a guide element 108. The mounted portion 110 provides vertical and lateral support for the associated mast element 106 and the guide element 108 when mounted to a top edge of the holding tank (as shown).

When in use in the cover-tethering system 100, the mast element 106 attaches to the mounted portion 110 and extends radially inward from an edge (e.g., the outer perimeter) of the holding tank 102. In one implementation, the mast element 106 extends toward a center of the holding tank. The mast element 106 of FIG. 1 has a longitudinal axis oriented substantially perpendicular to a sidewall of the holding tank 102. In other implementations, the mast element 106 is angled with respect to the sidewall of the holding tank 102. The mast element 106 may be a variety of shapes and manufactured from a variety of materials suitable for supporting a torque applied via the guide element 108.

The guide element 108 is an elongated implement that vertically descends from the mast element 106 into the holding tank 102. In FIG. 1, the guide element 108 is sufficiently offset from the sidewall of the holding tank 102. An upper end of the guide element 108 is attached to upper end to the mast element 106 at a point that is radially interior to the perimeter of the holding tank 102. The guide element 108 may be a rope, wire, chain, cable, rod, or any other suitable load-bearing implement.

The guide element 108 of each of the cover-tethering mounts 104 and 105 is inserted through a corresponding cover-holding element 120 attached to a holding tank cover 112. Each of the cover-holding elements 120 may be a ring or other threading detail such as a hole, loop, slot, grommet, etc. The holding element 120 has an opening shaped and sized to receive a lower end of the corresponding guide element 108.

When each of the guide elements 108 of the cover-tethering mounts 104 and 105 are inserted through an associated holding element 120, the holding elements 120 can moveably slide along a vertical length (e.g., z-axis) of the associated guide element 108. The mast elements 106 each prevent the associated cover-holding element 120 from sliding (by wind uplift or otherwise) off the upper end of the guide element 108. The cover holding elements 120 are each prevented from sliding off of the lower end of the guide element 108 by a ballast 126 that tensions the guide element 108 in the direction of gravity. Thus, in one implementation, the longitudinal axis of the guide element 108 is substantially along the direction of gravity.

Because each of the cover-holding elements 120 can move freely along the vertical axis of the tethering guide element 108, the holding tank cover 112 can rise and fall along with volumetric changes in liquid and/or gas within the holding tank 102. However, lateral movement (e.g., movement in the x-y plane) of the holding tank cover 112 is substantially prevented or mitigated by the cover-tethering system 100. In one implementation, the holding tank cover 112 maintains a substantially consistent shape when there are volumetric changes in a liquid and/or gas stored within the holding tank 102.

Although two cover-tethering mounts are shown in FIG. 1, more than two mounts are typically used to secure the holding tank cover 112 within the tank. The number of cover-tethering mounts utilized in a given system may vary depending upon the size and shape of the holding tank 102 and the materials chosen for the holding tank cover 112. When in use, the cover-tethering mounts used in the floating cover system 100 may be evenly or unevenly distributed around the perimeter of the holding tank 102. In one implementation, the holding tank 102 has a diameter of more than 150 yards and the cover-tethering mounts may be spaced between about 15 to 35 feet apart from one another. In systems with larger covers, the cover-tethering mounts may be spaced at greater distances from one another than in systems with smaller covers.

Cover-tethering systems the same or similar to FIG. 1 can be used in conjunction with any type of containment structure including both in-ground and above-ground tanks or reservoirs of multitudes of different shapes. The containment structure may have a flat or sloping base and vertical or sloped sidewalls. In one implementation, the holding tank 102 has a sloped base such that the tank has a greater depth in the center of the tank than around the edges.

The cover-tethering systems and methods disclosed herein may be utilized with a variety of technology including systems for odor and algae control, water storage, waste management, oil and gas production (such as a fracking tanks), debris barriers, evaporative control, avian protection, etc.

Figure 2:
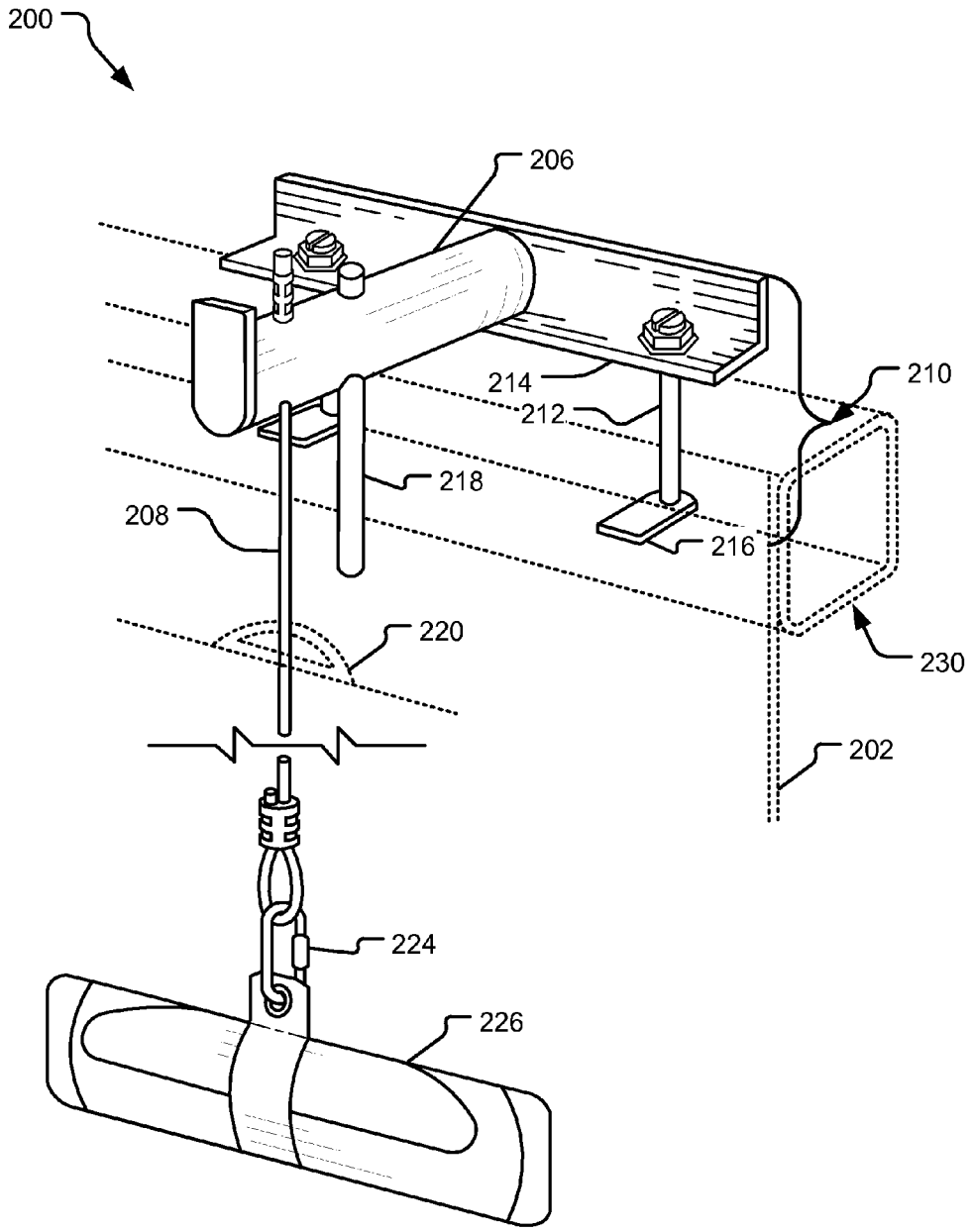
FIG. 2 illustrates an example cover-tethering mount for use in a cover-tethering system.

FIG. 2 illustrates an example cover-tethering mount 200 for use in a cover-tethering system. The cover-tethering mount 200 is removably secured to the top edge of the holding tank sidewall 202 and includes a mounting portion 210, a mast element 206, and a guide element 208. The mounting portion 210 mounts to the holding tank sidewall 202 and provides vertical and lateral support for the mast element 206 and guide element 208.

Although a variety of mounting mechanisms are contemplated for use in the cover-tethering mount 200, the mounting portion 210 is secured to the edge of the holding tank sidewall 202 by a saddle-like structure that includes a resting element 214, an inside leg 218, and outside legs (e.g., a visible outside leg 212 with a corresponding planar support element 216).

When the cover-tethering mount 200 is secured to the holding tank sidewall 202 (as illustrated), the resting element 214 rests adjacent to and in contact with a top surface of the holding tank sidewall 202. The resting element 214 attaches to the outside legs (e.g., the visible outside leg 212), which extend a vertical distance (e.g., a such as a few inches) down from the resting element 214 along an exterior surface of the holding tank sidewall 202. The outside legs are each attached to planar support elements (e.g., a planar support element 216) that are secured below an outer rim 230 of the exterior surface.

The inside leg 218 of the cover-tethering mount 200 is secured adjacent to and in contact with an interior surface of the holding tank sidewall 202 (e.g., a surface opposite the exterior surface). The distance between the inside leg 218 and the outside leg 212 may vary according to the dimensions of the holding tank 202 and/or may be adjustable. Example mechanisms that provide for adjustable separation between the inside leg 218 and outside leg 212 are illustrated in FIGS. 3-5C.

The structure of the mounting portion 210 may vary depending on the shape of the tank. For example, a holding tank without an outer rim (e.g., the outer rim 230) might utilize a "saddle-shaped" mounting mechanism similar to FIG. 2 but without the planar support element 216. Alternatively, the mounting portion 210 might fixedly attach to the holding tank itself, such as by a dowel pin and hole drilled into the top of the tank. In yet another implementation, the mounting portion 210 is fused or bolted directly to the holding tank sidewall 202.

In an implementation where the holding tank is an in-ground tank, the mounting portion 210 secures the cover-tethering mount 200 to the ground adjacent to the holding tank sidewall 202 or to an external structure. For example, the mounting portion 210 may include a stake (not shown) that can be driven into the ground adjacent the holding tank, while the mast portion 206 extends radially inward from the staking point.

The resting element 214 of the mounting portion 210 attaches to and provides support for the mast portion 206 of the cover-tethering mount 200, which extends radially inward from the holding tank sidewall 202. In the implementation shown, the mast portion 206 is oriented substantially perpendicular to the holding tank sidewall 202. However, in other implementations, the mast portion 206 extends toward the center of the holding tank at an obtuse or acute angle.

The mast element 206 attaches to an upper end of the guide element 208 at a point radially interior to the holding tank sidewall 202. The guide element 208 is a load-bearing implement that descends into the holding tank. In one implementation, the guide element 208 is a slender rigid member, such as a rod, that is tensioned by its own mass. In another implementation, the guide element 208 is a lightweight rope or cable that is tensioned by a mass attached to its lower end (e.g., such as a weighted ballast 226). If the guide element 208 is sufficiently flexible, the mast element 206 may be used as a spool, around which the guide element (e.g., cable, rope, chain, etc.) is wrapped to take-up slack or to raise or lower the position of the weighted ballast 226.

In FIG. 2, the guide element 208 is secured to the mast element 206 on an upper end. A lower, opposite end of the guide element 208 descends into the holding tank and attaches to the weighted ballast 226. In this or another implementation, a longitudinal axis of the guide element 208 aligns with the direction of gravity (e.g., substantially perpendicular to a flat base of the holding tank).

A cover-holding element 220 can slideably couple to the guide element 208 between the upper and lower ends of the guide element 208. The cover-holding element 220 can be, for example, a ring or other receiving element with an opening therein. In the implementation of FIG. 2, the cover-holding element 220 is a D-shaped ring which is attached (e.g., sewn) to a perimeter of a holding tank cover, such as a floating cover. In another implementation, the cover-holding element 220 is a reinforced ring of another shape (e.g., circular, oval, rectangular, irregular, etc.). In yet another implementation, the guide element 208 is an elongated cuff which may include bearings or friction-reducing elements to prevent torqueing.

The weighted ballast 226 tensions the guide element 208 in the direction of gravity and is removably attached to the guide element 208 by a carabiner 224. Other temporary attachment mechanisms such as snaps, ties, latches, etc. are also contemplated in place of the carabiner 224. In one implementation, the weighted ballast 226 is replaced with a weighted or unweighted T-shaped toggle.

In FIG. 2, the guide element 208 and weighted ballast 226 are positioned such that they do not, in the absence of an applied force, contact either the base of the holding tank or the walls of the holding tank.

Any or all of the components of the cover-tethering mount 200 can be made from metal (such as aluminum, stainless steel, galvanized metal, etc.), plastic, or fiberglass, or other supportive and weather-durable material. In one implementation, powder-coated steel is used.

Figure 3:
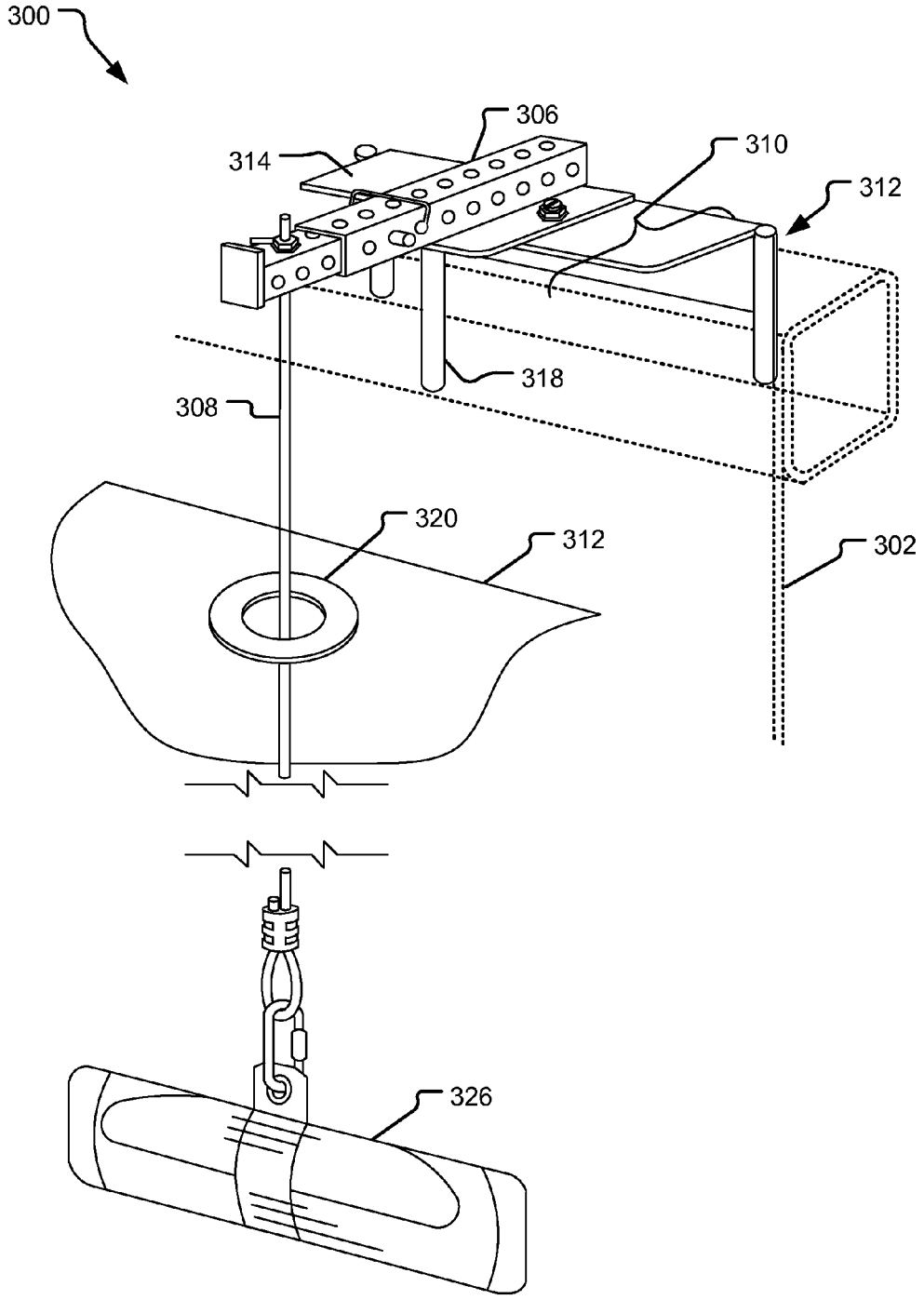
FIG. 3 illustrates another example cover-tethering mount for use in a cover-tethering system.

FIG. 3 illustrates another example cover-tethering mount 300 for use in a cover-tethering system. The cover-tethering mount 300 is removably secured to the top edge of a holding tank sidewall 302 and includes a mounting portion 310, an adjustable mast element 306, and a guide element 308. The mounting portion 310 mounts to the holding tank sidewall 302 and provides vertical and lateral support for the adjustable mast element 306 and a guide element 308.

The mounting portion 310 is secured to the edge of the holding tank 302 by a saddle-like structure that includes a resting element 314, a planar outer leg 312, and an inner peg leg 318. When the cover-tethering mount 300 is secured to the edge of the holding tank 302 (as illustrated), the resting element 314 rests above the holding tank 302 such that it is adjacent to and in contact with a top surface of the holding tank sidewall 302. The resting element 314 is substantially perpendicular to the planar outside leg 312, which extends a vertical distance (e.g., a such as a few inches) down from the resting element 314 along an exterior surface of the holding tank sidewall 302.

The inside leg 318 of the cover-tethering mount 300 is secured adjacent to and in contact with an interior surface of the holding tank 302. The distance between the inner leg 318 and the planar outside leg 312 can be varied using one or more nut-and-bolt adjustment mechanisms (e.g., a nut-and-bolt adjustment mechanism 330).

The adjustable mast element 306 is a telescoping tubing that allows an inner end of the adjustable mast element 306 (i.e., the end distal to the holding tank sidewall 302) to be moved toward or away from the holding tank sidewall 302 while the cover-tethering mount 300 is secured to the holding tank sidewall 302. In another implementation, the adjustable mast element 306 is a slotted channel that can be secured at a variety of positions relative to the mounting portion 310.

The thickness of the guide element 308 is such that the guide element 308 may be inserted through a cover-holding element 320 attached to a holding tank cover 312. In FIG. 3, the holding element 320 is a reinforced ring. This or a similar reinforced ring is shown in greater detail in FIG. 9.

Figure 4A:
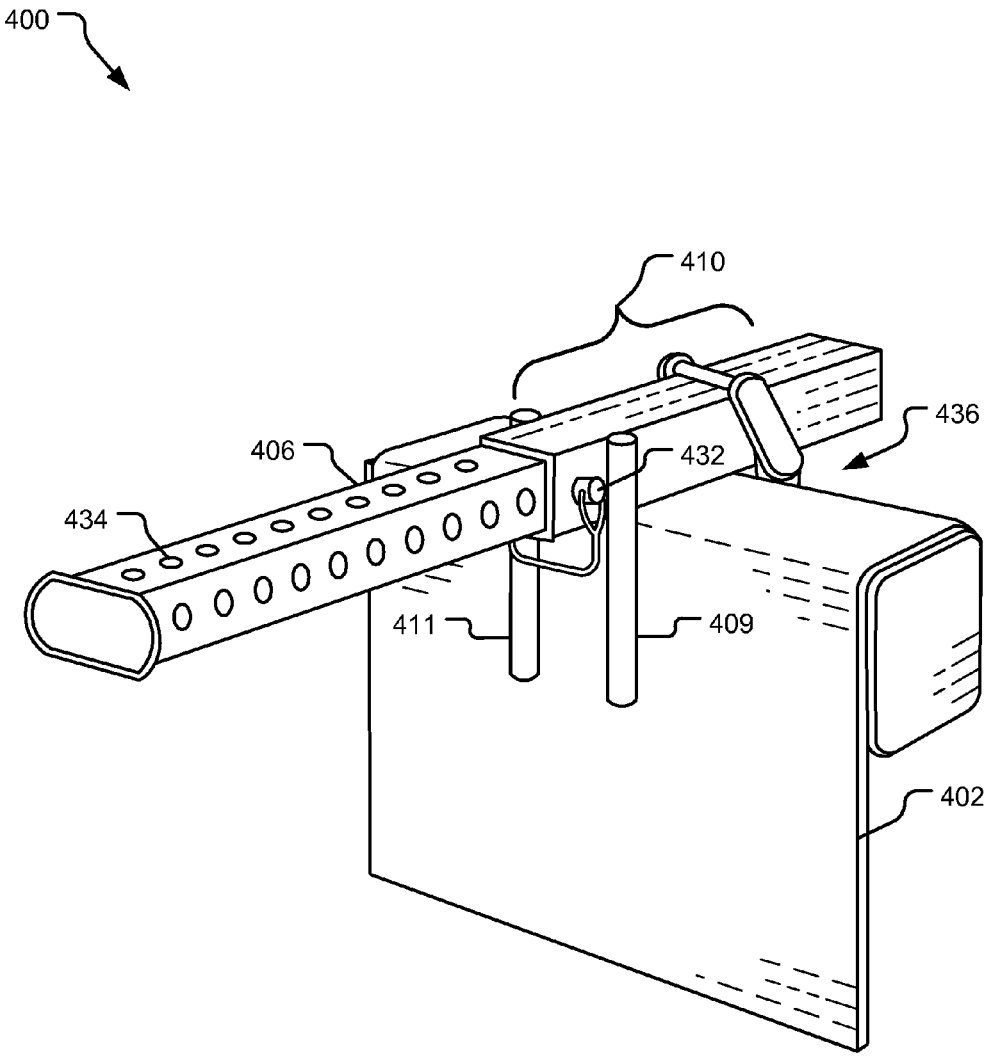
FIG. 4A illustrates a front perspective view of another example cover-tethering mount for use in a cover-tethering system.

FIG. 4A illustrates a front perspective view of another example cover-tethering mount 400 for use in a cover-tethering system. The cover-tethering mount 400 includes a mounting portion 410 and an adjustable mast portion 406. The mounting portion 410 includes inner legs 409 and 411 that rest adjacent to an interior surface of the holding tank sidewall 402 when the mounting portion 410 is mounted thereto. The mounting portion 410 also includes a sliding jaw 436 that can be adjusted to accommodate varying wall thicknesses. The adjustable mast portion 406 is a telescoping tubing that can be secured in place by a dowel pin 432. The adjustable mast portion 406 has holes (e.g., a hole 434) extending through upper and lower surfaces of the adjustable mast portion 406, which can be used to secure an upper end of a guide element, such as the guide element 308 of FIG. 3, to the adjustable mast portion 406.

Figure 4B:
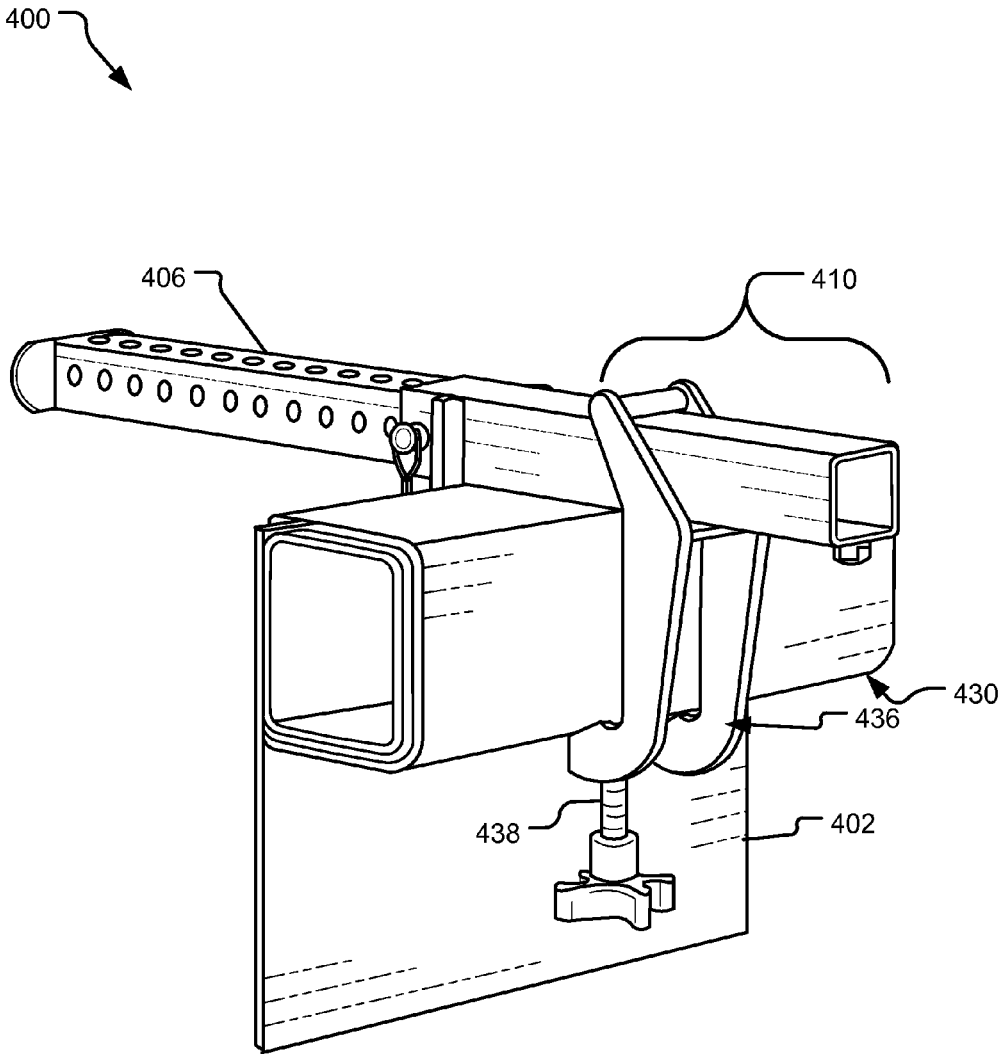
FIG. 4B illustrates a rear perspective view of the example cover-tethering mount of FIG. 4A.

FIG. 4B illustrates a side perspective view of the example cover-tethering mount 400 of FIG. 4A. The sliding jaw 436 is positioned adjacent to the exterior surface of the holding tank sidewall 402, and is slideably attached to the adjustable mast portion 406 to allow for adjustable separation between the inner legs (i.e., the inner legs 409 and 411 visible in FIG. 4A) and the sliding jaw 436. A thumb screw 438 can be tightened to supply a force against the lower rim 430 of the holding tank sidewall 402 (as shown), securing the sliding jaw 436 in a desired position relative to the inner legs 409 and 411 (shown in FIG. 4A).

Figure 4C:
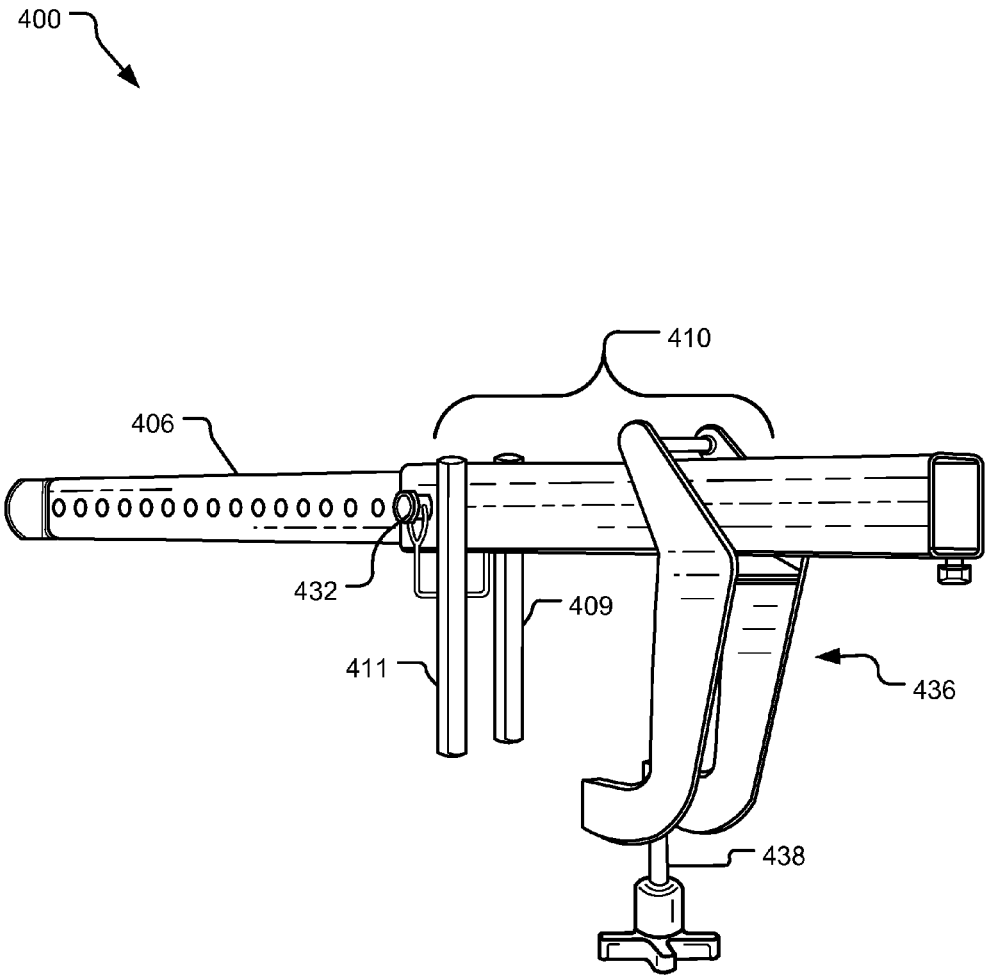
FIG. 4C illustrates a side perspective view of the example cover-tethering mount of FIGS. 4A and 4B.

FIG. 4C illustrates a side perspective view of the example cover-tethering mount 400 of FIGS. 4A and 4B.

Figure 5A:
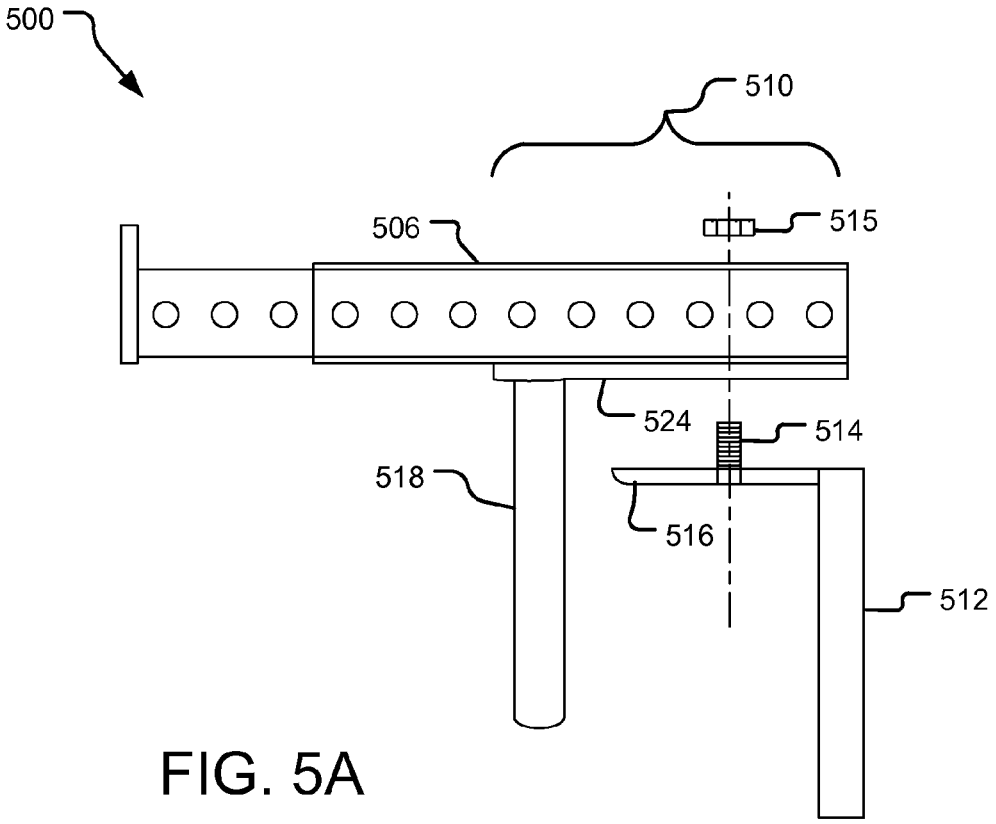
FIG. 5A illustrates a side view of another example cover-tethering mount with components in a disassembled position.

FIG. 5A illustrates a side view of another example cover-tethering mount 500 with components in a disassembled position. The cover-tethering mount 500 includes an adjustable mast portion 506 and a mounting portion 510. The adjustable mast portion 506 includes telescoping tubing that allows for a length of the adjustable mast portion 506 to be adjusted by moving an inner square tube in and out of an outer square tube. A guide element (not shown) can be secured to an end of the inner square tube and separated from a tank sidewall (not shown) by an adjustable distance.

The mounting portion 510 further includes one or more inner legs 518 and a planar outer leg 512. The inner legs 518 are non-movably attached to the adjustable mast portion 506 and to a mating plate 524. The planar outer leg 512 includes a substantially orthogonal planar top portion 516 that can be secured to the mating plate 524 by inserting threaded studs (e.g., a threaded stud 514) of the planar top portion 516 through corresponding slots (not shown) in the mating plate 524. Once inserted through the corresponding slots, nuts (e.g., a nut 515) can be screwed onto the threaded studs to secure the outer leg 512 at a desired position relative to the inner leg 518. Thus, the distance between the planar outer leg 512 and the inner legs 518 is adjustable for ease of attachment and compatibility in different holding tanks having variable edge sizes.

Together, the outer square tube of the mast portion 506, the inside leg 518 and the outside leg 512 form a saddle to fit over a holding tank sidewall. In alternate implementations, this "saddle" can consist of any number of rods or clamping fixtures.

Figure 5B:
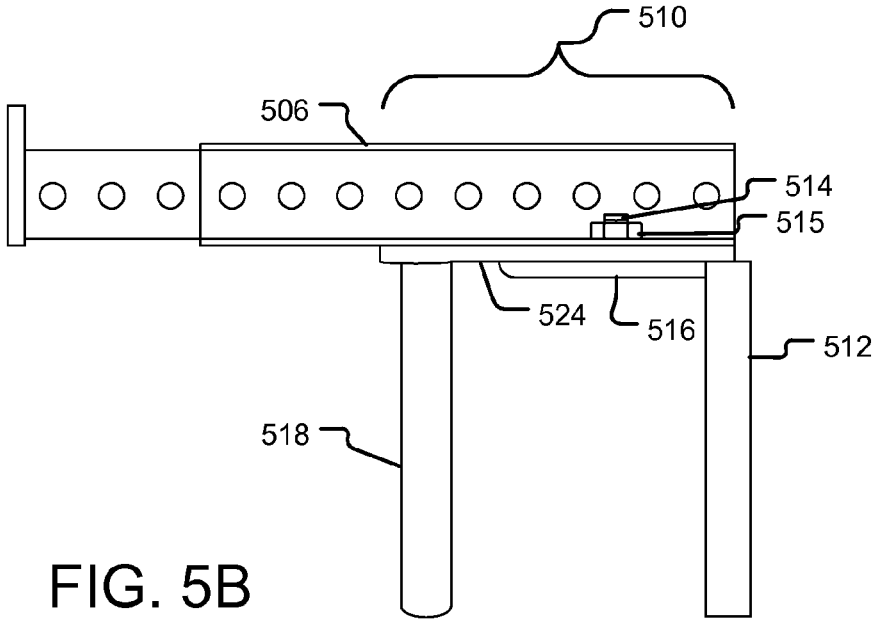
FIG. 5B illustrates another side view of the cover-tethering mount of FIG. 5A with components in an assembled position.

FIG. 5B illustrates another view of the cover-tethering mount 500 of FIG. 5A. Components of the cover-tethering mount 500 are shown in an assembled position.

Figure 5C:
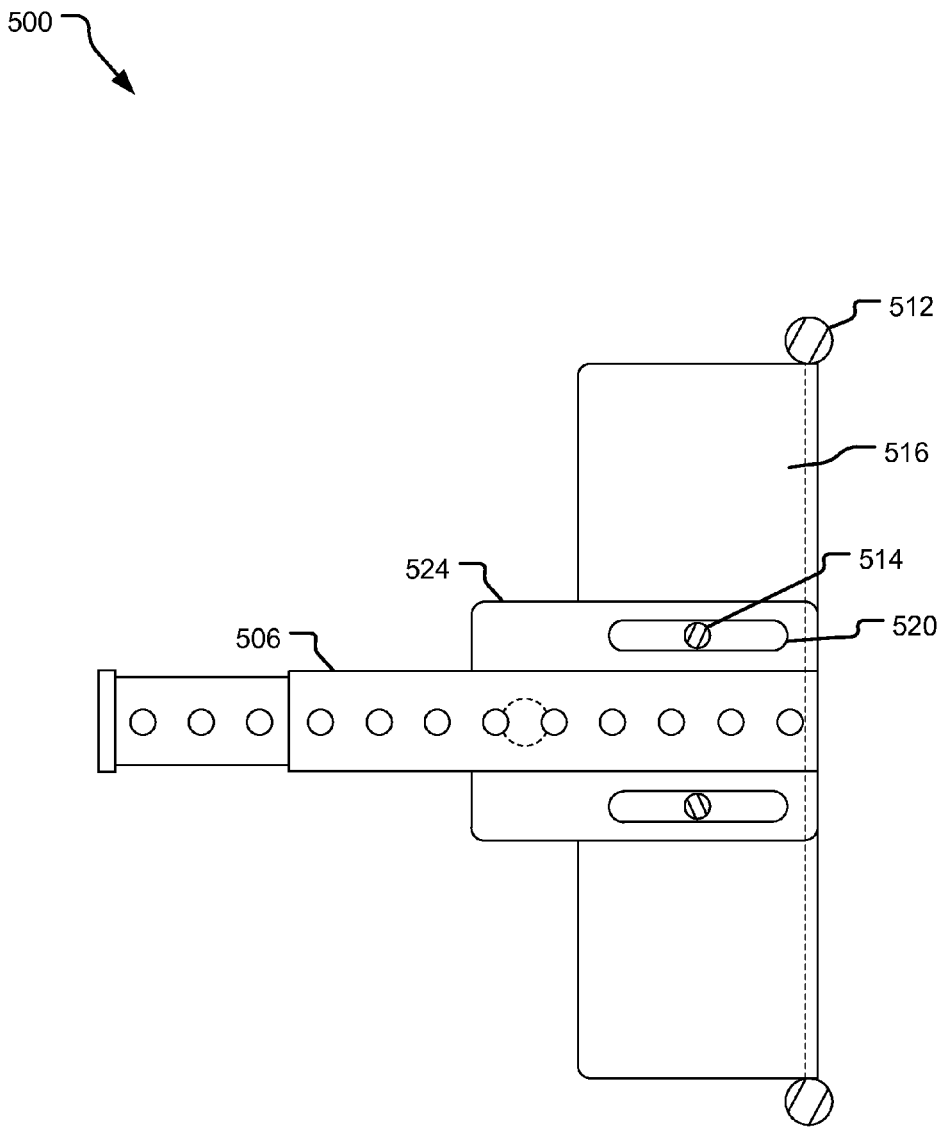
FIG. 5C illustrates a top-down view of the cover-tethering mount of FIGS. 5A and 5B.

FIG. 5C illustrates a top-down view of the cover-tethering mount 500 of FIGS. 5A and 5B. The mating plate 524 is shown connected via nuts and threaded studs (e.g., a threaded stud 514) to the planar top portion 516 of the planar outer leg 512.

The threaded studs are threaded through each of two slotted holes (e.g. a slotted hole 520) in the mating plate 524. Each of the slotted holes is configured to receive a corresponding threaded stud of the outer leg (e.g., a threaded stud of the outer leg 512, as shown in FIGS. 5A and 5B).

Figure 6:
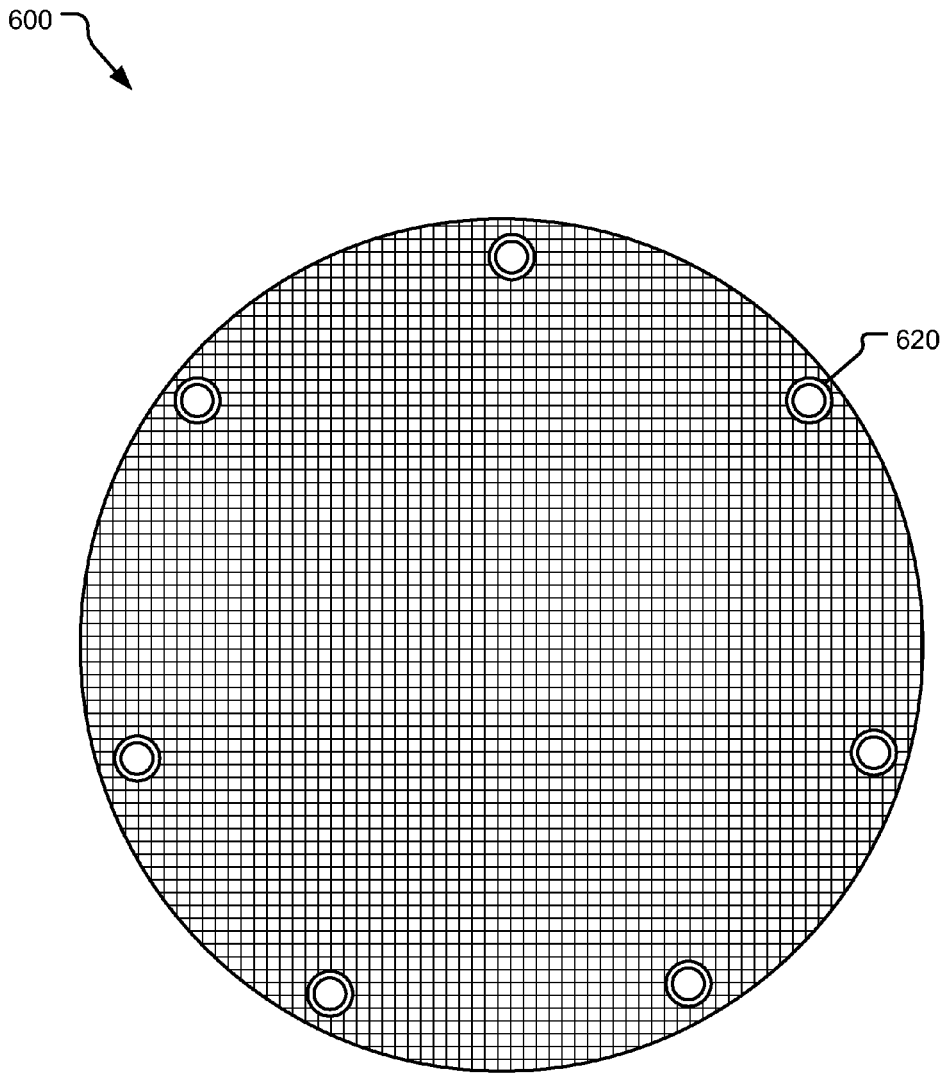
FIG. 6 illustrates a top-down view of a cover suitable for use in an example cover-tethering system.

FIG. 6 illustrates a top-down view of a tank cover 600 suitable for use in a cover-tethering system. The tank cover 600 is circular and suitable for use in a circular holding tank (not shown); however, a range of shapes are contemplated for covers used in non-circular holding tanks. As used herein, the term "tank cover" includes tank and reservoir covers for both in-ground and above ground systems.

The tank cover 600 includes a plurality of reinforced cover-holding elements (e.g., a cover-holding element 620) that are substantially evenly spaced around the cover 600 periphery. The cover-holding elements are each sized and shaped to receive a corresponding guide element (not shown). In one implementation, the cover-holding elements are reinforced rings. In other implementations, the cover-holding elements are rings of any shape or any alternate threading detail such as a hole, loop, slot, grommet, etc.

The tank cover 600 can be a rigid, semi-rigid, or flexible cover made out of a variety of materials. Suitable materials for flexible covers include without limitation flexible geomembrane materials such as scrim reinforced polyethylene, polypropylene, Elvaloy® Interpolymer (or "EIA") alloy, or Chlorosulfonated polyethylene. In other implementations, the tank cover 600 is made out of non-reinforced materials such as "bubble wrap" styled cover materials and high-density polyethylene. The implementations disclosed herein are intended to be used in combination with both permeable and impermeable cover materials.

The tank cover 600 may be buoyant or non-buoyant. In one implementation where the tank cover 600 is non-buoyant, the tank cover 600 is kept afloat by buoyant components of one or more cover-tethering mounts. In various implementations, the tank cover 600 fully or partially comprises insulating and/or thermal blanket-style materials such as foams (e.g., closed cell polyethylene or expanded polystyrene foams) which may be linked, laminated, or deployed as encapsulated planking and reflective insulation and polymer aerogel materials. Additionally, the cover 600 may be a single piece assembly or consist of modular formats pieced together to form a floating cover assemblage.

In one implementation, the tank cover 600 includes multiple layers of different materials stacked together. For example, one layer may provide for buoyancy, another for insulation, and another can be water impervious to prevent rain water infiltration. In another implementation, the tank cover 600 has an interior layer consisting of several air pockets (i.e., a bubble-wrap style material) to keep it afloat.

In another implementation, the tank cover 600 has one or more cover drains to allow for the runoff of rain and snow. For example, a number of drain-channels may be evenly or unevenly spaced about the cover. In particular, a series of perforated holes may be included at the seams of different materials pieced together. These drain-channels or "holes" allow liquid precipitation to drip through the tank cover 600 and into a holding tank below.

In one implementation, the tank cover 600 contains an inner-layer of foam padding that keeps it afloat. The foam padding may be thicker in the middle than near the cover periphery to create an increased buoyancy near the center of the tank cover 600. As a result, precipitation on the cover drips toward the edges of the tank cover 600 and into a holding tank below.

Figure 7:
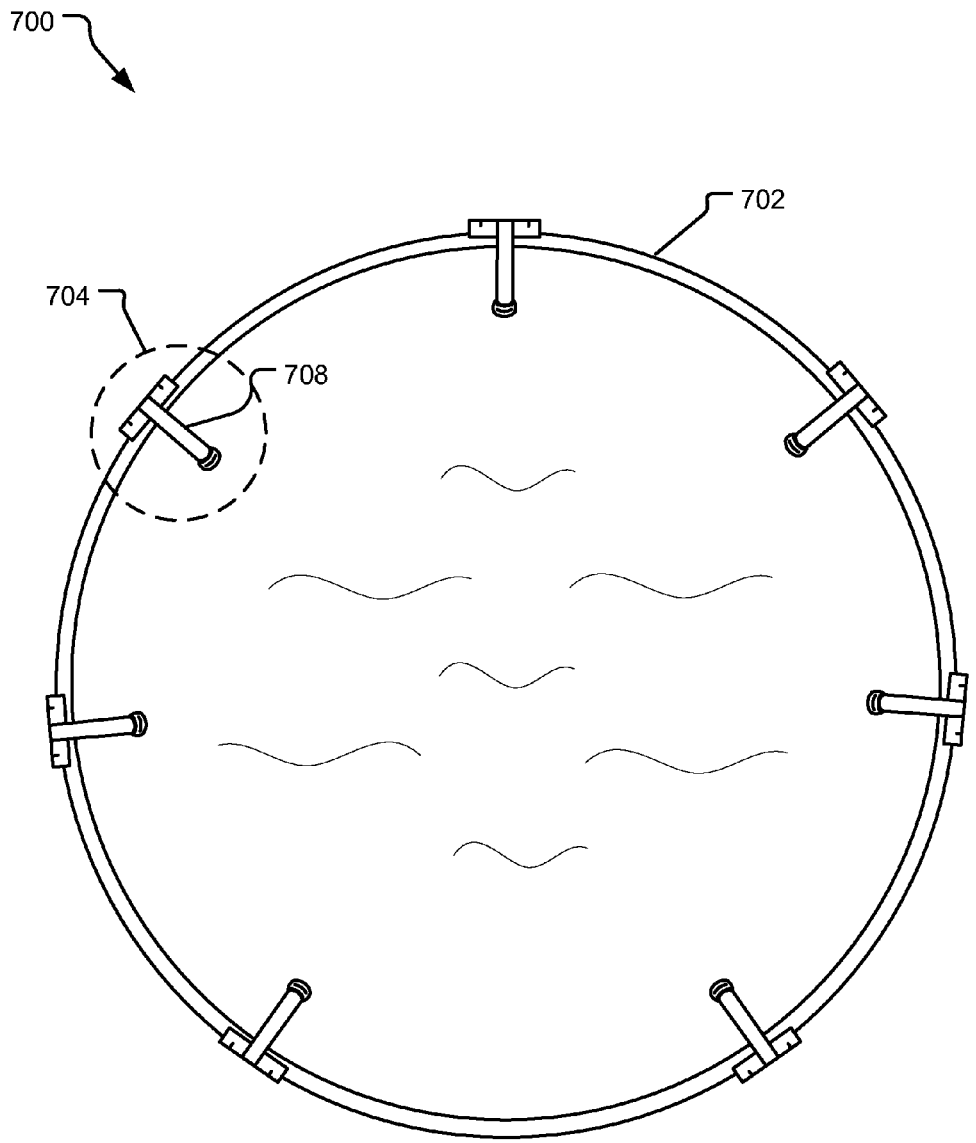
FIG. 7 illustrates a top-down view of another example cover-tethering system.

FIG. 7 illustrates a top-down view of a cover-tethering system 700. The cover-tethering system includes a plurality of cover-tethering mounts (e.g., a cover-tethering mount 704) spaced substantially evenly around the periphery of the holding tank 702 and mounted to an upper edge of the holding tank 702. The cover-tethering mounts can be used to secure a cover (not shown) within the holding tank 702.

The holding tank 702 is filled with a liquid and/or gas (e.g., water, liquid waste, petroleum, etc.) which partially submerges each of the cover-tethering mounts. Each of the cover-tethering mounts includes a guide element (e.g., a guide element 708) that descends into the holding tank 702 without touching an edge of the holding tank 702. The cover-tethering mounts of FIG. 7 may be suitable for use with a tank cover the same or similar to that illustrated in FIG. 6. Other features of the cover-tethering system 700 not explicitly described may be the same or similar to other implementations described herein.

Figure 8:
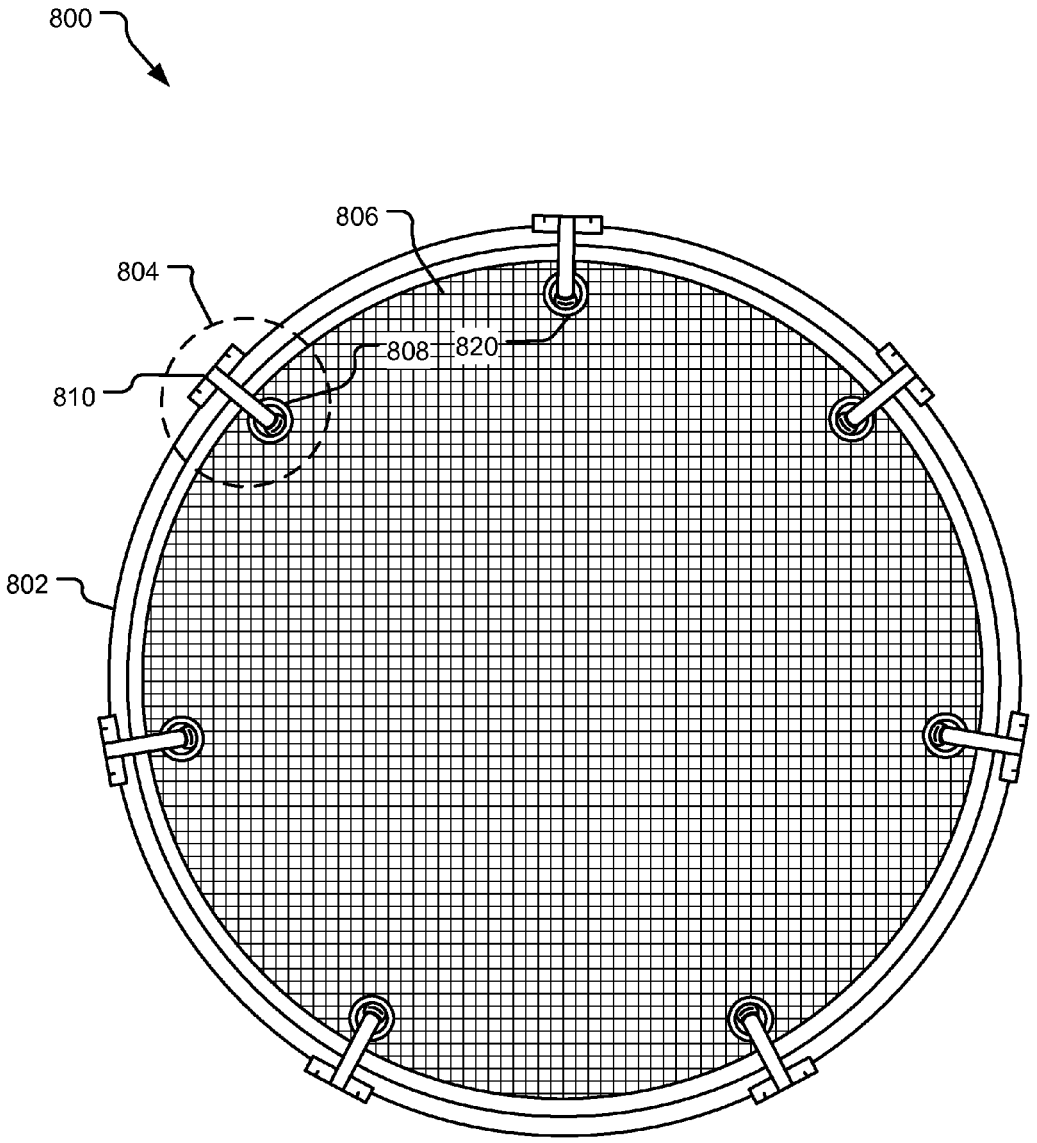
FIG. 8 illustrates a top-down view of yet another cover-tethering system.

FIG. 8 illustrates a top-down view of another cover-tethering system 800. The cover-tethering system 800 includes a cover 806 secured within a holding tank 802 by a plurality of cover-tethering mounts (e.g., a cover-tethering mount 804). The cover 806 includes a plurality of reinforced cover-holding elements (e.g., cover-holding elements 808, 820) that are each configured to receive a guide element of one of the cover-tethering mounts.

To secure the cover 806 within the holding tank 802, a guide element of each of the cover-tethering mounts is inserted through a corresponding cover-holding element. In one implementation, a securing element, such as a ballast (not shown), is removably affixed to the lower end of each guide element. Other features of the cover-tethering system 800 not explicitly described may be the same or similar to other implementations described herein.

Figure 9:
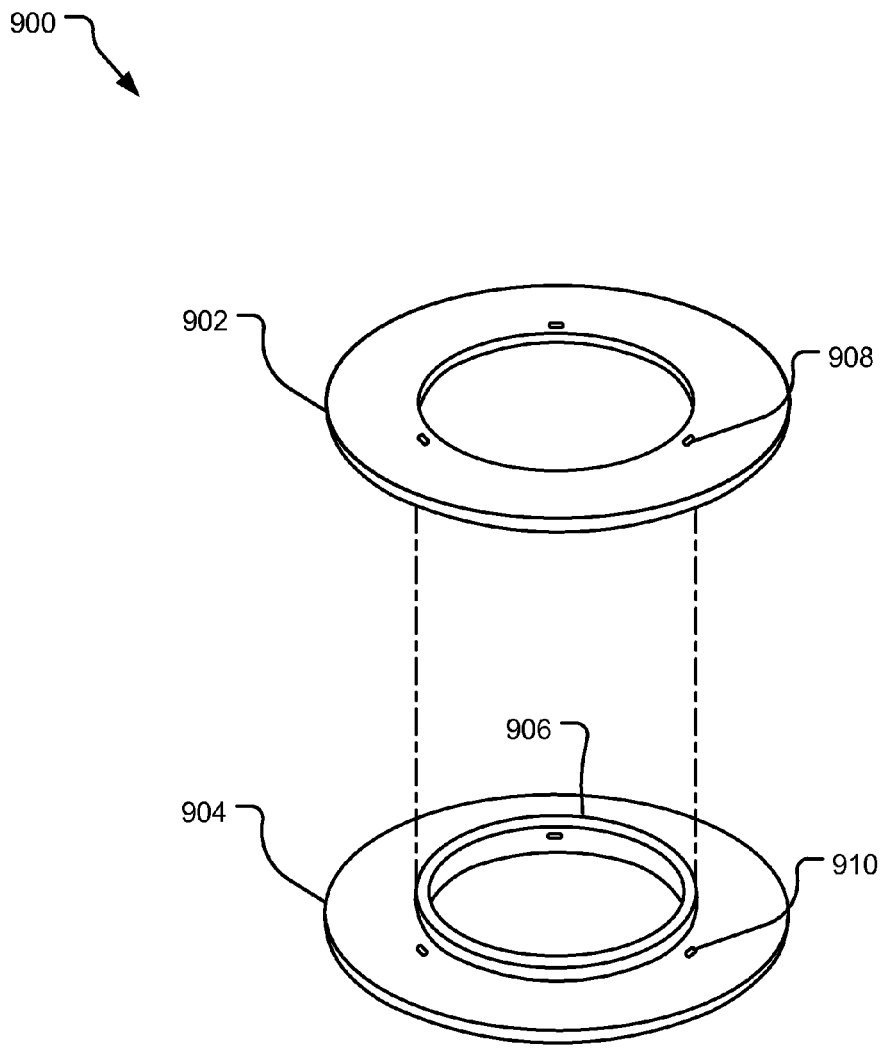
FIG. 9 illustrates an example cover-holding element suitable for use in a cover-tethering system.

FIG. 9 illustrates an example cover-holding element 900 suitable for use in a cover-tethering system. The cover-holding element 900 is a reinforced ring including an upper portion 902 and a lower portion 904. The lower portion has a protruding inner flange 906 sized to nest within a central aperture of the upper portion 902. Upper slots (e.g., an upper slot 908) in the upper portion 902 correspond with lower slots (e.g., a lower slot 910) in the lower portion.

To secure the cover-holding element 900 on a tank cover (not shown), the upper portion 902 and lower portion 904 can be placed on opposite sides of a flexible cover (not shown) and aligned so that the inner flange 906 of the lower portion 904 nests within or adjacent to the aperture of the upper portion 902. The upper portion 902 and lower portion 904 can be secured relative to one another by threading a tie mechanism (not shown) through each slot pair (e.g., a slot pair 908 and 910) and through the cover therebetween. Each tie mechanism can be tied off (e.g., opposite ends can be tied together) to secure the upper portion 902 and the lower portion 904 relative to one another. In one implementation, the tie mechanism used is a zip tie.

Either before or after the cover-holding element 900 is attached to the tank cover, a hole may be cut into the tank cover that is sized and shaped to align with the central aperture of the cover holding element 900. The cover-holding element 900 can be made of a variety of materials. However, in one implementation, the rings are made of a plastic acrylic slip.

Figure 10:
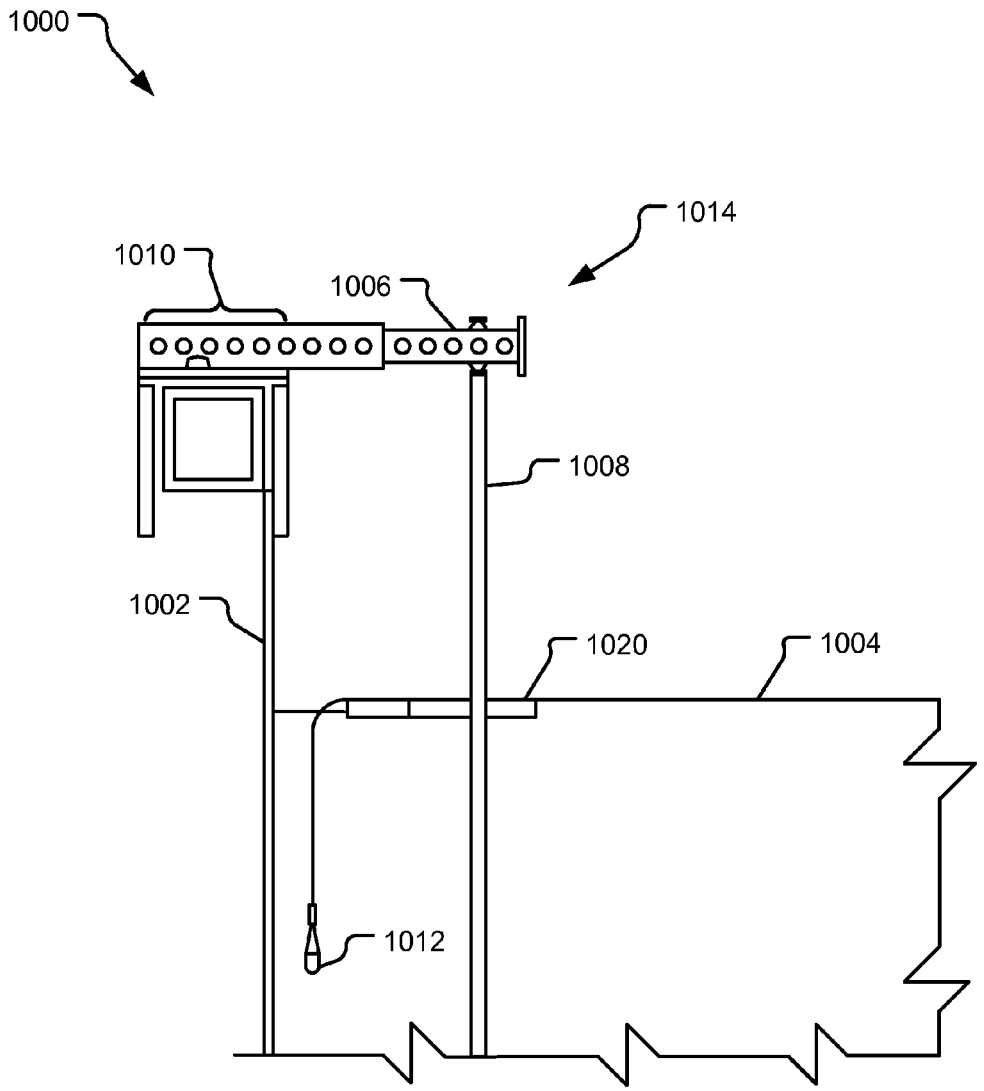
FIG. 10 illustrates a side profile view of components of yet another example cover-tethering system.

FIG. 10 illustrates a side profile view of components of another cover-tethering system 1000. The system 1000 includes a cover-tethering mount 1014 and a floating cover 1004. The cover-tethering mount 1014 is removably secured to the top edge of a holding tank sidewall 1002 and includes a mounting portion 1010, an adjustable mast element 1006, and a guide element 1008.

The floating cover 1004 includes a cover-holding element 1020, which may be a reinforced ring or other threading detail including an aperture sized to receive the guide element 1008. The floating cover 1004 has a weighted perimeter 1012 which causes the edges of the floating cover 1004 to sink below the surface level of liquid in the holding tank 1002. In operation, the weighted perimeter 1012 prevents air from getting underneath the cover during high wind events. In FIG. 1000, the weighted perimeter 1012 includes a closed hem in the cover material with weights positioned inside of the hem.

Figure 11:
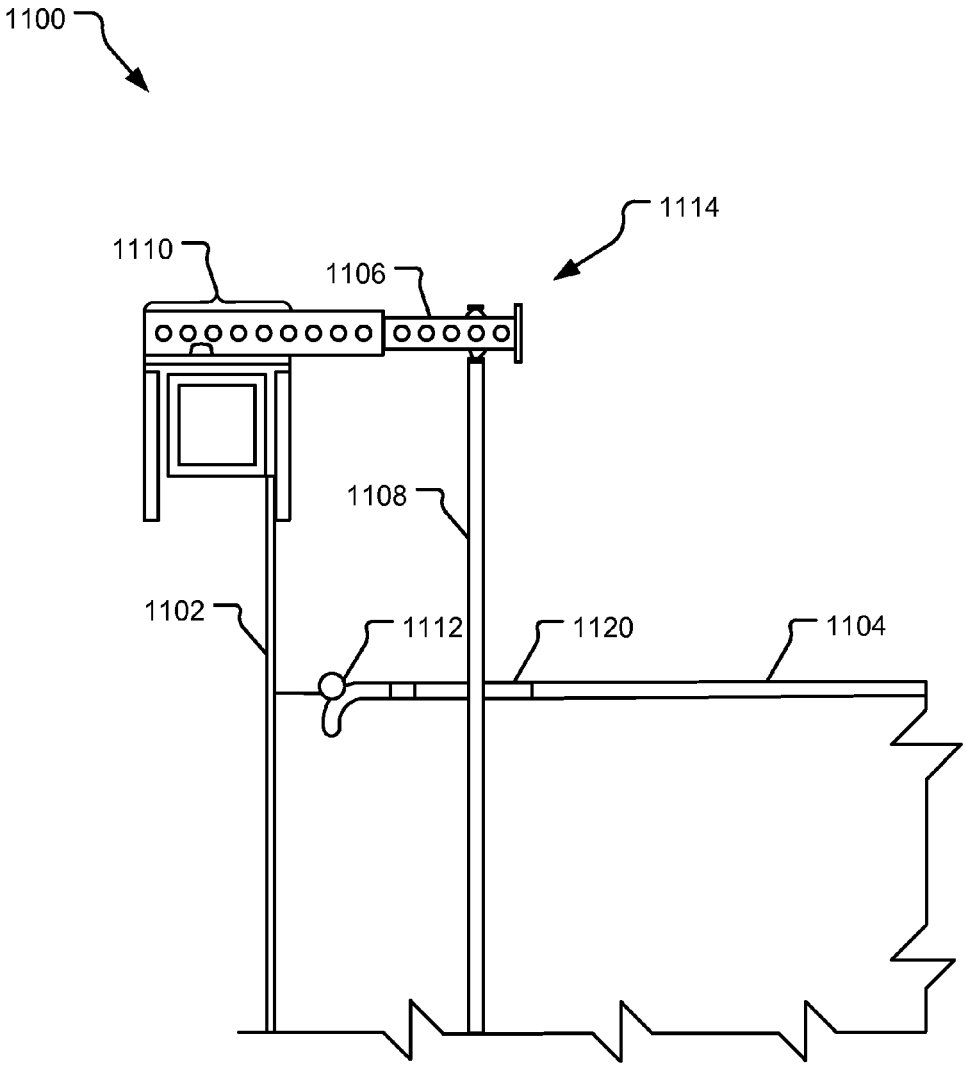
FIG. 11 illustrates a side profile view of components of another cover-tethering system.

FIG. 11 illustrates a side profile view of components of another cover-tethering system 1100. The system 1100 includes a cover-tethering mount 1114 and a floating cover 1104. The cover-tethering mount 1114 is removably secured to the top edge of a holding tank sidewall 1102 and includes a mounting portion 1110, an adjustable mast element 1106, and a guide element 1108. The floating cover 1104 has a cover-holding element 1120, which may be a reinforced ring or other aperture sized to receive and slideably couple to the guide element 1108.

The floating cover 1104 has a weighted perimeter 1112 that causes the edges of the floating cover 1004 to sink below the surface level of liquid in the holding tank 1002. The weighted perimeter 1112 is a weighted cable is attached to an upper side of the perimeter of the floating cover 1004.

Figure 12:
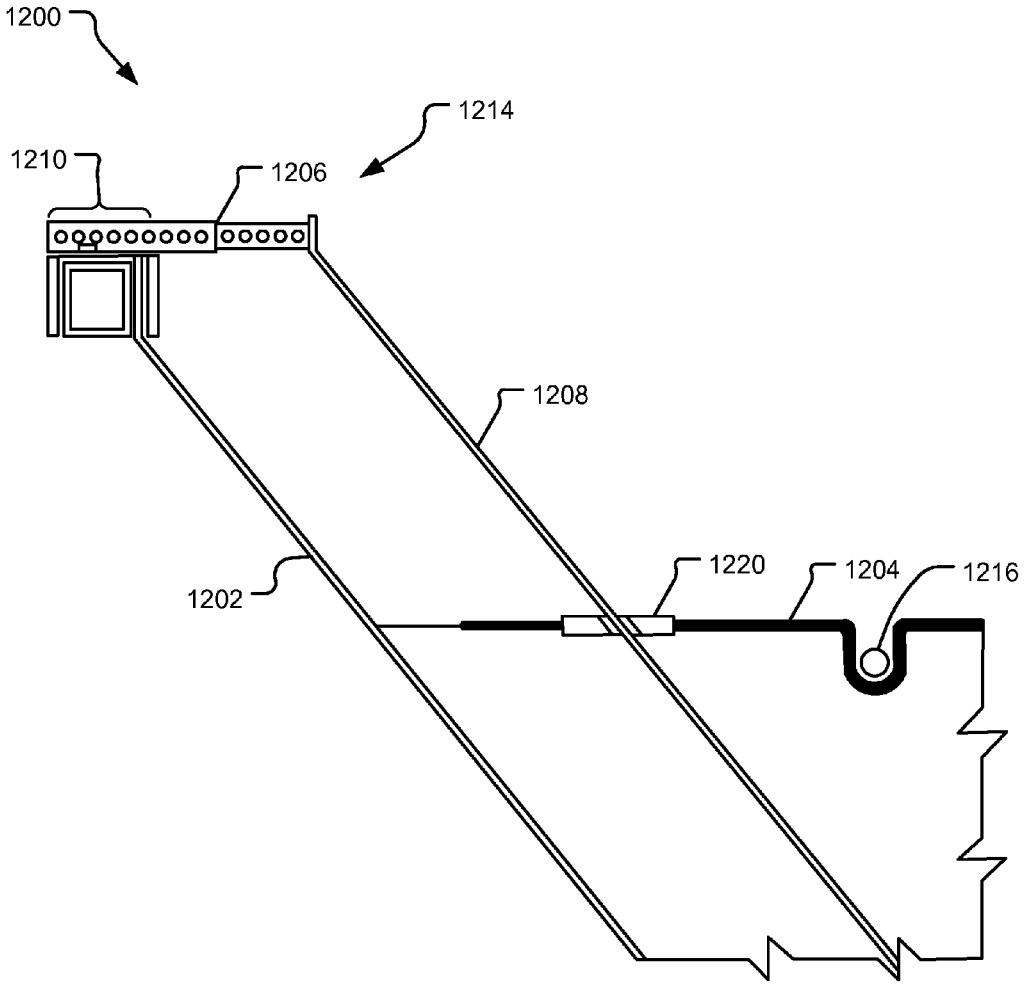
FIG. 12 illustrates a side profile view of components of another cover-tethering system.

FIG. 12 illustrates a side profile view of components of another cover-tethering system 1200. The system 1200 includes a cover-tethering mount 1214, a floating cover 1204, and holding tank with a sloped sidewall 1202. The cover-tethering mount 1214 is removably secured to the top edge of the holding tank sidewall 1202 and includes a mounting portion 1210, an adjustable mast element 1206, and a rigid guide element 1208. The rigid guide element is secured at an angle substantially parallel to the sloped sidewall 1202 so that it does not touch the sloped sidewall 1202 or the base of the holding tank. The rigid guide element 1208 is threaded through a cover-holding element 1220 of the floating cover 1204.

In FIG. 12, the sloped tank sidewall may contribute to uneven tension forces acting on the floating cover 1204 as the volume within the tank rises and falls. For example, slack may form in the floating cover 1204 as the volume of liquid in the tank decreases. If not secured, this additional slack material may be susceptible to lift up during high wind events. Thus, a weighted ballast element 1216 is included on top of the floating cover 1204 to tension additional slack as it forms. As the liquid level is reduced, the weighted ballast element 1216 may sink lower and lower toward the base of the tank, adding tension to the additional slack material.

Figure 13:
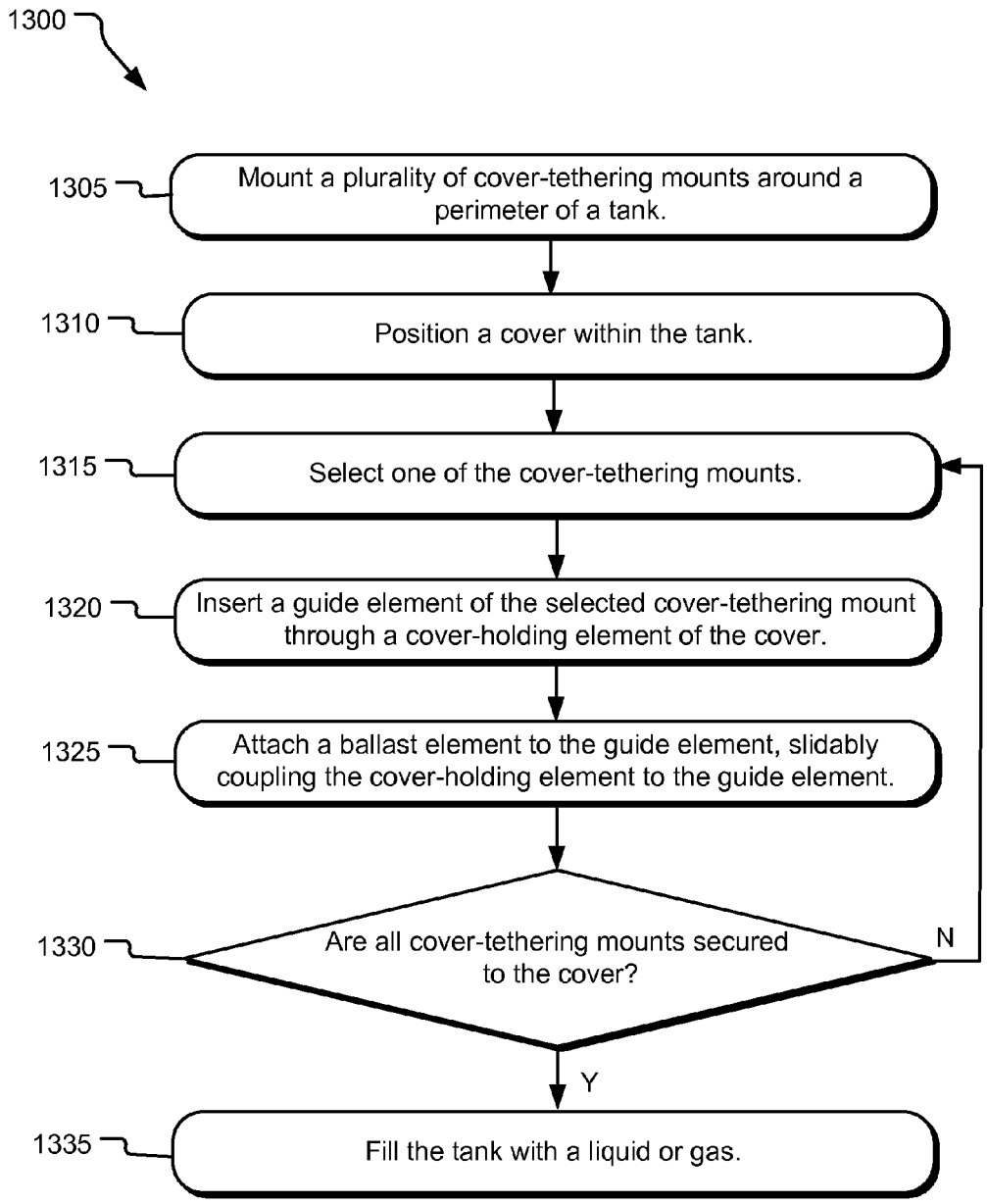
FIG. 13 illustrates example operations for securing a cover within a holding tank using a cover-tethering system.

FIG. 13 illustrates example operations 1300 for securing a cover within a holding tank. A mounting operation 1305 mounts a plurality of cover-tethering mounts around the perimeter of the holding tank. Each cover-tethering mount includes a mounted portion that mounts to the tank wall and a mast element that extends radially from the mounted portion toward the tank interior. In one implementation, the mast element is substantially orthogonal to the tank wall and parallel to a flat, unsloped based of the holding tank. In other implementations, the mast element is slanted with respect to the tank wall and/or the base of the holding tank.

An end of the mast element that is distal to the mounted portion is attached to an upper end of an elongated guide element, such as a rod, cable, rope, etc. A lower end of the guide element descends into the holding tank. In one implementation, the guide element is separated from the tank wall so that no part of the guide element touches the tank wall.

A positioning operation 1310 positions a cover within the holding tank. In various implementations, the cover may a flexible, semi-flexible, or rigid cover and either buoyant or non-buoyant. In at least one implementation, the cover is a flexible, floating cover. The cover has plurality of cover-holding elements attached around its perimeter. The cover-holding elements may be rings (e.g., a reinforced ring) or other threading detail such as a hole, loop, slot, grommet, etc.

A selection operation 1315 selects one of the mounted cover-tethering mounts. An insertion operation 1320 positions a portion of the cover such that a guide element of the selected cover-tethering mount is inserted through a corresponding cover-holding element. The cover-holding element fully encircles the guide element.

An attachment operation 1325 attaches a ballast to the lower end of the guide element below the cover-holding element. In one implementation, the ballast is a weighted sack, such as a sack filled with sand, gravel, etc. In the same or another implementation, the ballast attaches to the lower-end of the guide element by a detachable clip element that easily opens and closes, such as a carabiner. The ballast has a diameter that is larger than a diameter of the aperture in the cover-holding element such that the ballast cannot, or cannot without considerable manipulation, slide through the aperture in the cover-holding element. However, the cover-holding element can freely slide along the longitudinal axis of the guide element, allowing the cover to rise and fall with volumetric changes to a liquid stored within the holding tank.

A determination operation 1330 determines whether each of the cover-holding elements is coupled to a corresponding guide element. If one or more cover-holding elements are not yet coupled, another cover-tethering mount is selected and operations 1315-1330 are repeated until all of the cover-tethering mounts have been coupled to corresponding cover-holding elements.

If the determination operation 1330 determines that each of the cover-holding elements is coupled to a corresponding guide element, a filling operation 1335 fills the holding tank with a volume of liquid and/or gas. The cover floats on the surface of the volume and rises along with the surface.

To remove (e.g., un-tether) the cover from each of the cover-tethering mounts, each of the ballast elements may be detached from the associated guide element, and the guide elements may be unthreaded from the holding elements.

In another implementation (not shown), the tank cover is attached to each of the cover-tethering mounts after the tank is filled with a volume of liquid. For example, a cover may be positioned and attached to a tank that already contains a liquid, such as a wastewater treatment clarifier pond. If the cover is a buoyant cover, the cover can be deployed on top of the liquid and positioned in the same manner as that described above (e.g., so that the cover holding elements each align with a corresponding cover-tethering mount). A rigid guide element (e.g., a rod) can then be attached to each cover-tethering mount, such as by threading the rigid guide element through holes on a mast element (e.g., as shown in FIG. 3), and then threading the rigid guide element through a corresponding holding element on the cover. This arrangement can be especially useful in liquid containments such as clarifiers that are maintained to have a static water elevation during operation.

The above specification, examples, and data provide a complete description of the structure and use of exemplary embodiments of the invention. Since many embodiments of the invention can be made without departing from the spirit and scope of the invention, the invention resides in the claims hereinafter appended. Furthermore, structural features of the different embodiments may be combined in yet another embodiment without departing from the recited claims.

What is claimed is:

1. A system comprising:

a holding tank;

a flexible floating cover;

a mounting piece that secures to a sidewall of the holding tank;

a mast element extending above an interior of a holding tank and having a first end attached to the mounting piece;

a guide element with a first end attached to a second opposite end of the mast element, the guide element having a longitudinal axis extending into the interior of the holding tank, the longitudinal axis attached to or including a ballast element that hangs freely within the holding tank without contacting a base of the holding tank, wherein the guide element is configured to extend through and slideably engage an aperture in the flexible floating cover to allow the floating cover to rise and fall along the longitudinal axis of the guide element between the first end of the guide element and the ballast element responsive to changes to a volume stored within the holding tank.

2. The apparatus of claim 1, wherein a longitudinal axis of the guide element is substantially parallel to a direction of gravity.

3. The apparatus of claim 1, wherein the mounting piece has an adjustable offset mechanism that controls a distance between the guide element and the edge of the holding tank.

4. The apparatus of claim 1, wherein the ballast is secured to the second opposite end of the guide element and remains stationary relative to the rise and fall of the flexible floating cover along the longitudinal axis of the guide element.

5. The apparatus of claim 1, wherein the mounting piece further comprises at least two legs configured to rest adjacent to opposite surfaces of the sidewall.

6. A system comprising:

a holding tank;

a mounting piece that mounts to a sidewall of the holding tank;

a guide element with a first end securable to the mounting piece and a second opposite end that extends into the holding tank and is attached to a ballast element that hangs freely within the holding tank without contacting a base of the holding tank, wherein the guide element has a longitudinal axis that extends through and slideably engages an aperture formed in a holding tank cover to allow the holding tank cover to rise and fall along the longitudinal axis between the first end and a second opposite end of the guide element responsive to changes to a volume stored within the holding tank; and a telescoping mast element having a longitudinal body between a first end attached to the mounting piece and a second opposite end attached to the guide element, wherein the longitudinal body adjustably extends radially inward from a perimeter of the holding tank.

7. The system of claim 6, wherein the longitudinal axis of the guide element is substantially parallel to a direction of gravity.

8. The system of claim 6, wherein the aperture is part of a reinforced cover-holding element.

9. The system of claim 6, wherein the ballast is secured to the second opposite end of the guide element and remains stationary relative to the rise and fall of the holding tank cover along the longitudinal axis of the guide element.

10. The system of claim 6, wherein the mounting piece further comprises at least two legs configured to rest adjacent to opposite surfaces of the sidewall.

11. The system of claim 6, wherein the aperture is positioned proximal to an outer perimeter of the holding tank cover.

12. A method comprising:

securing a cover-tether mount to a sidewall of a holding tank, the cover-tether mount attached to a first end of a guide element separated from the sidewall and having a longitudinal axis extending into an interior of the holding tank;

slideably coupling an aperture formed in a flexible holding tank cover to the guide element by threading the longitudinal axis of the guide element through the aperture, wherein the coupling permits the flexible holding tank cover to rise and fall along the longitudinal axis of the guide element between the first end of the guide element and a second opposite end of the guide element responsive to changes to a volume stored within the holding tank; and securing the second opposite end of the guide element to a ballast element within the holding tank such that the ballast element hangs freely within the holding tank without contacting a base of the holding tank, the ballast element preventing the aperture of the flexible holding tank cover from decoupling from the guide element.

13. The method of claim 12, wherein the ballast remains stationary relative to the rise and fall of the holding tank cover along the longitudinal axis of the guide element.

14. The method of claim 13, wherein the ballast, aperture, and guide element are each separated from the sidewall of the holding tank.

15. The method of claim 12, wherein the cover-tether mount includes a telescoping mast element that adjustably extends radially inward of a perimeter of the holding tank.

16. The method of claim 12, wherein the cover-tether mount has an adjustable offset mechanism that controls a separation distance between the guide element and the sidewall of the holding tank.

17. The method of claim 12, wherein the cover-tether mount further comprises at least two legs configured to rest adjacent to opposite surfaces of the sidewall.

18. The method of claim 12, wherein a longitudinal axis of the guide element is substantially parallel to a direction of gravity.

19. A system comprising:

a holding tank;

a flexible floating cover;

a mounting piece that secures to a sidewall of the holding tank;

a mast element extending above an interior of a holding tank and having a first end attached to the mounting piece;

a guide element with a first end attached to a second opposite end of the mast element, the guide element having a longitudinal axis extending into the interior of the holding tank with a second opposite end that hangs freely and is unattached to the holding tank, wherein the guide element is configured to extend through and slideably engage an aperture in the flexible floating cover to allow the floating cover to rise and fall along the longitudinal axis of the guide element between the first end of the guide element and the ballast element responsive to changes to a volume stored within the holding tank.

20. A system comprising:

a holding tank;

a flexible floating cover;

a mounting piece that secures to a sidewall of the holding tank;

a mast element extending above an interior of a holding tank and having a first end attached to the mounting piece;

a guide element with a first end attached to a second opposite end of the mast element, the guide element including a self-tensioned elongated rigid member, the self-tensioned elongated rigid member extending into the interior of the holding tank and including an end that hangs freely within the holding tank without contacting a base of the holding tank, wherein the guide element is configured to extend through and slideably engage an aperture in the flexible floating cover to allow the floating cover to rise and fall along the longitudinal axis of the guide element between the first end of the guide element and the ballast element responsive to changes to a volume stored within the holding tank.

* * * * *